US005733384A

United States Patent [19]

Cao et al.

[11] Patent Number: 5,733,384

[45] Date of Patent: Mar. 31, 1998

[54] PROCESS FOR PRODUCING HARD-MAGNETIC PARTS

[75] Inventors: Lei Cao; Axel Handstein; Karl-Hartmut Mueller; Ludwig Schultz, all of Dresden; Volker Neu, Rastatt, all of Germany

[73] Assignee: Institut fuer Festkoerper-und Werkstofforschung, Dresden, Germany

[21] Appl. No.: 793,156

[22] PCT Filed: Jun. 1, 1996

[86] PCT No.: PCT/EP96/02379

§ 371 Date: Feb. 11, 1997

§ 102(e) Date: Feb. 11, 1997

[87] PCT Pub. No.: WO97/00524

PCT Pub. Date: Jan. 3, 1997

[30] Foreign Application Priority Data

Jun. 14, 1995 [DE] Germany ..... 195 21 221.5

[51] Int. Cl.[6] ..... H01F 1/058

[52] U.S. Cl. ..... 148/104; 148/105

[58] Field of Search ..... 148/101, 103, 148/104, 105

[56] References Cited

U.S. PATENT DOCUMENTS

| | | | |
|---|---|---|---|
| 4,192,696 | 3/1980 | Menth et al. | 148/101 |
| 5,007,972 | 4/1991 | Kumar et al. | 148/105 |

FOREIGN PATENT DOCUMENTS

| | | | |
|---|---|---|---|
| 0 397 264 | 11/1990 | European Pat. Off. . | |
| 41 34 245 | 4/1993 | Germany . | |
| 42 43 048 | 6/1994 | Germany . | |
| 63-9733 | 3/1988 | Japan | 148/103 |
| 63-308904 | 12/1988 | Japan | 148/105 |
| 4-176805 | 6/1992 | Japan | 148/105 |

OTHER PUBLICATIONS

Journal of Applied Physics, vol. 75, No. 10, B. Shen et al., "A Novel Hard Magnetic Material For Sintering Permanent Magnets", pp. 6253–6255, May 1994.

Jouranal of Applied Physics, vol. 75, No. 1,L. Kohg et al., "High Coercivty Sm–Fe–C compounds with Th2Zn17 Structure By Melt Quenching", pp. 6250–6252, May 1994.

Applied Physics Letters, vol. 68, No. 1, Cao et al., "Highly Coercive Sm2Fe15Ga2C2 Mgnets Made By Intense Ball Milling", pp. 129–131, Jan. 1996.

*Primary Examiner*—John Sheehan

*Attorney, Agent, or Firm*—McAulay Fisher Nissen Goldberg & Kiel, LLP

[57] ABSTRACT

A process is provided for a technologically controllable, economic production of hard-magnetic parts from $Sm_2$—$(Fe,M)_{17}$—$C_y$-base work materials with interstitial inclusions, where M designates gallium and/or at least one metallic element serving to stabilize a rhombohedral 2:17 structure. A $Sm_2Fe_{17-x}M_xC_y$ powder mixture is produced, where $x>0.1$ and $3\geqq y\geqq 0$. The mixture is subjected to an intensive fine grinding process in a ball mill. The finely ground mixture is heat-treated in a temperature range from 650° C. to 900° C. for partial or complete recrystallization. The resulting ultra-fine-grain $Sm_2Fe_{17-x}M_xC_y$ magnetic powder is compacted to produce magnet bodies by a hot pressing processing in a temperature range from 650° C. to 900° C. The process is applicable, for example, for the production of hard-magnetic parts based on interstitial $Sm_2Fe_{17}C_y$ compounds.

12 Claims, No Drawings

PROCESS FOR PRODUCING HARD-MAGNETIC PARTS

BACKGROUND OF THE INVENTION a) Field of the Invention

The invention relates to the field of metallurgical process technology and is concerned with a process for the production of hard-magnetic parts from $Sm_2$—$(Fe,M)_{17}$—$C_y$-base work materials with interstitial insertions or inclusions, where M designates gallium and/or at least one metallic element serving to stabilize a rhombohedral 2:17 structure.

The process is applicable, for instance, for the production of hard-magnetic parts based on interstitial $Sm_2Fe_{17}C_y$-compounds.

b) Description of the Related Art

Owing to their advantageous intrinsic properties (high Curie temperature, saturation polarization and anisotropic field strength), $Sm_2Fe_{17}X_y$ compounds with interstitial inclusions, where X=carbon or nitrogen, have very good preconditions for application as permanent magnet materials (J. M. Coey and H. Sun, *J. Magn. Magn. Mater.* 87 (1990) L 251).

While nitrogen can be included in such work materials only by way of a gas-solid reaction up to y=3, carbon can be included via this reaction or by melt-metallurgical processes. The $Sm_2Fe_{17}X_y$ compounds produced by the gas phase reaction are unstable at temperatures above 600° C. (B.-P. Hu and G.-C. Liu, *Solid State Commun.* 79 (1991) 785; C. Kuhrt, M. Katter, K. Schnitzke and L. Schultz, *Appl. Phys. Letters* 60 (1992) 2029). Therefore, it is not possible to use heat treatments to achieve a greater density, e.g., the powder sintering applied in Nd—Fe—B permanent magnets.

The $Sm_2Fe_{17}C_y$ carbon compounds are unstable when y>1. The carbon content of $Sm_2Fe_{17}C_y$ can be increased to y>1 by substituting gallium for iron as a precondition for improving the interstitial characteristics, since the gallium addition stabilizes the rhombohedral 2:17 structure of the compound which is necessary for good magnetic properties (B.-G. Shen, L.-S. Kong, F.-W. Wang and L. Cao, *Appl. Phys. Letters* 63 (1993) 2288).

A hard-magnetic iron rare-earth metal alloy with a $ThMn_{12}$ structure is known from DE 41 33 214 A1. During production of this alloy, the starting powder must be heat-treated in $N_2$ gas or nitrogen-containing gases in order to obtain the hard-magnetic phase. The nitrides which occur in this process have inadequate thermal stability, so that the powders must generally be fixed in wax according to a magnetic field orientation to avoid compaction at higher temperatures.

It is also known to produce quick-solidifying strips, e.g., from $Sm_2Fe_{15}Ga_2C_2$, directly from the melt. However, there was no indication of any method for the further processing of this material to produce magnets such as the hot pressing and hot deformation methods applied for quick-solidifying Nd—Fe—B materials (R. W. Lee, *Appl. Phys. Letters* 46 (1985)

SUMMARY OF THE INVENTION

The object of the invention is to provide a process for technologically controllable, economic production of hard-magnetic parts from $Sm_2$—$(Fe,M)_{17}$—$C_y$-base work materials with interstitial inclusions, where M designates gallium and/or at least one metallic element serving to stabilize a rhombohedral 2:17 structure.

This object is met, according to the invention, by the production process described in the patent claims.

The process is characterized in that a) a $Sm_2Fe_{17-x}M_xC_y$ powder mixture is produced, where $x>0.1$ and $3\geqq y\geqq 0$;

b) the mixture is subjected to an intensive fine grinding process in a ball mill;

c) the finely ground mixture is heat-treated in the temperature range of 650° C. to 900° C. for partial or complete recrystallization; and d) the resulting ultra-fine-grain $Sm_2Fe_{17-x}M_xC_y$ magnetic powder is compacted to form magnet bodies by means of a hot pressing processing in a temperature range from 650° C. to 900° C.

The magnet bodies obtained in this way have an isotropic magnetic behavior and can subsequently be provided, according to the invention, with a preferred magnetic orientation by means of a hot deformation process at a temperature ranging from 650° C. to 900° C. and at a pressure of more than 200 MPa.

In accordance with a first embodiment of the process according to the invention, samarium can be mixed with iron, M and carbon or with an iron-carbon alloy and M in finely dispersed form in a ratio corresponding to the composition of $Sm_2Fe_{17-x}M_xC_y$, where $x>0.1$ and $3\geqq y\geqq 0$, in order to produce the powder mixture in process step a).

In this connection, at least one element from the group of elements comprising aluminum, molybdenum, niobium, tantalum, titanium and zirconium can be used for M instead of or in combination with gallium.

Particularly high remanence values are achieved according to the invention by producing the starting mixture with a quantity of samarium such that a samarium content of less than 10 to 3 At-% results in the end product of the process, by generating a grain size of less than 200 nm proceeding from this starting mixture in step b) by selection of the grinding intensity and grinding duration, and by limiting the grain growth to a value of less than 200 nm in the following steps c) and d) and, in the event of a subsequent hot deformation of the magnet body, by selection of the heat treatment parameters.

Melt-metallurgical processes can also be used to produce the powder mixture in process step a) according to a second embodiment of the process, according to the invention, in that a $Sm_2Fe_{17-x}M_xC_y$ alloy, where $x>0.1$ and $3\geqq y\geqq 0$, is first melted and then subjected to a homogenizing annealing in a temperature range of900° C. to 1200° C. after solidification, and the alloy is then comminuted to a powder.

In this connection, at least one element from the group of elements comprising aluminum, molybdenum, niobium, tantalum, titanium and zirconium can be added for M instead of or in combination with gallium.

Particularly high remanence values are achieved in the second embodiment of the process according to the invention when an alloy is produced with samarium in an amount such that the samarium content in the end product of the process is less than 10 to 3 At-%, when a grain size of less than 200 nm is produced in step b) by selecting the grinding intensity and grinding duration, and when the grain growth is limited to a value less than 200 nm in the following steps c) and d) and, in the event of a subsequent hot deformation of the magnet body, by selecting the heat treatment parameters.

In order to produce the powder mixture in process step a), a $Sm_2Fe_{17-x}Ga_xC_y$ alloy, where $x>0.1$ and $2\geqq y\geqq 0$, can also be produced by melt-metallurgical methods according to another embodiment of the process according to the invention. After solidification, this alloy is subjected to a homogenizing annealing in a temperature range of 900° C. to 1200° C. and the alloy is then comminuted to a powder. The powder is first subjected to an annealing treatment at temperatures from 600° C. to 900° C. in hydrogen gas and then under a vacuum. The powdered alloy is then alloyed up to a $Sm_2Fe_{17-x}Ga_xC_y$ alloy, where $y \leqq 3$, by means of heat treatment in a temperature range from 400° C. to 600° C. in a carbon-containing gas.

$CH_4$ or $C_2H_2$ can be used as carbon-containing gas to alloy the powder.

The process according to the invention provides the preconditions for producing compacted metal from the interstitial compound $Sm_2(Fe,M)_{17}C_y$ in an efficient and economical fashion. It is also advantageous that the process can be carried out with the metallurgical installations conventionally employed in permanent magnet production and is simple to handle.

In contrast to the $Sm_2Fe_{17}X_y$ work materials, where $y \leqq 3$, which are produced via gas phase reactions and are only stable up to 600° C., the $Sm_2(Fe,M)_{17}C_y$ materials processed by means of the process according to the invention are stable up to temperatures of approximately 1000° C.

DETAILED DESCRIPTION OF THE INVENTION

The invention will be described more fully in the following with reference to embodiment examples. The method according to Example 1 is considered particularly advantageous.

EXAMPLE 1

Samarium, iron, gallium and carbon in finely dispersed form are mixed with a metal powder composed of $Sm_2Fe_{15}Ga_2C_2$ and ground intensively in a ball mill. The magnetically isotropic fine powder with a coercive field strength of roughly 1000 kA/m which is obtained in this way is subjected to heat treatment for recrystallization at 700° C. to 750° C. under vacuum or in an inert gas atmosphere. For production of a permanent magnet, this powder is compacted in a hot press at 700° C. to 750° C. under vacuum or in an inert gas atmosphere at a pressure of 300 MPa to 500 MPa for a period of 2 to 5 minutes. Compact permanent magnets with a coercive field strength corresponding to that of the ground powder are obtained.

EXAMPLE 2

The powder which is ground in accordance with Example 1 but is not subjected to heat treatment is placed in a hot press and compacted at 700° C. to 750° C. under vacuum or in an inert gas atmosphere at a pressure of 300 MPa to 500 MPa for 10 to 60 minutes. The heat treatment which is carried out in Example 1 as a separate process step prior to hot pressing takes place in Example 2 during the hot pressing process. Compact permanent magnets with a coercive field strength of approximately 1000 kA/m are obtained in this process.

EXAMPLE 3

The magnets obtained in Examples 1 and 2 which are characterized by an isotropic magnetic behavior are subjected to a hot deformation in a temperature range of 750° C. to 800° C. at a pressure of 300 MPa to 500 MPa under vacuum or in an inert gas atmosphere. Magnets with a preferred magnetic orientation are obtained.

EXAMPLE 4

After solidification, an alloy composed of $Sm_2Fe_{15}Ga_2C_2$ is homogenized, comminuted and subjected to an intensive grinding process. The magnetically isotropic fine powder with a coercive field strength of roughly 1000 kA/m which is obtained in this way is subjected to heat treatment for recrystallization at 700° C. to 750° C. under vacuum or in an inert gas atmosphere. For production of a permanent magnet, this powder is compacted in a hot press at 700° C. to 750° C. under vacuum or in an inert gas atmosphere at a pressure of 300 MPa to 500 MPa for a period of 2 to 5 minutes. Compact permanent magnets with a coercive field strength corresponding to that of the ground powder are obtained.

EXAMPLE 5

The powder which is ground in accordance with Example 4, but is not subjected to heat treatment, is placed in a hot press and compacted at 700° C. to 750° C. under vacuum or in an inert gas atmosphere at a pressure of 300 MPa to 500 MPa over a period of 10 to 60 minutes. The heat treatment which is carried out in Example 4 as a separate process step prior to hot pressing takes place during the hot pressing process in Example 5. Compact permanent magnets with a coercive field strength of approximately 1000 kA/m are obtained in this process.

EXAMPLE 6

After solidification, an alloy composed of $Sm_2Fe_{16}Ga_1$ is homogenized and comminuted at 1100° C. The powder is heated in a hydrogen atmosphere up to 750° C. and kept at this temperature for 60 minutes. The powder is then heated to 800° C. in a vacuum for 100 minutes and then cooled. A very fine-grained $Sm_2Fe_{16}Ga_1$ powder results and is subjected to a subsequent annealing in a methane atmosphere at 500° C. for a period of 6 hours to include the carbon. To produce a permanent magnet, the resulting $Sm_2Fe_{16}Ga_1C_{2.4}$ powder is compacted in a hot press at 700° C. to 750° C. under vacuum or in an inert gas atmosphere at a pressure of 300 MPa to 500 MPa for a period of 2 to 5 minutes.

EXAMPLE 7

The magnets obtained in Examples 4, 5 and 6 which are characterized by an isotropic magnetic behavior are subjected to hot deformation in a temperature range of 750° C. to 800° C. at a pressure of 300 MPa to 500 MPa under vacuum or in an inert gas atmosphere. Magnets with a preferred magnetic orientation are obtained.

While the foregoing description and drawings represent the preferred embodiments of the present invention, it will be obvious to those skilled in the art that various changes and modifications may be made therein without departing from the true spirit and scope of the present invention.

What is claimed is:

1. A process for the production of hard-magnetic parts from $Sm_2$—$(Fe,M)_{17}$—$C_y$-base work materials, where M designates at least one of gallium and at least one metallic element serving to stabilize a rhombohedral 2:17 structure, comprising the steps of:

a) producing a $Sm_2Fe_{17-x}M_xC_y$ powder mixture, where $x>0.1$ and $3 \geqq y \geqq 0$;

b) subjecting the mixture to an intensive fine grinding process in a ball mill;

c) heat-treating the finely ground mixture in a temperature range from 650° C. to 900° C. for partial or complete recrystallization; and d) compacting the resulting ultra-fine-grain $Sm_2Fe_{17-x}M_xC_y$ magnetic powder to produce a magnet body by means of a hot pressing processing in a temperature range from 650° C. to 900° C.

2. The process according to claim 1, wherein the compacted magnet body is provided with a preferred magnetic orientation by means of a hot deformation process at a temperature ranging from 650° C. to 900° C. and at a pressure of more than 200 MPa.

3. The process according to claim 1, wherein samarium is mixed with iron, M and carbon or with an iron-carbon alloy and M in finely dispersed form, the mixture being in a ratio corresponding to the composition of $Sm_2Fe_{17-x}M_xC_y$, where $x>0.1$ and $3\geqq y\geqq 0$, in order to produce the powder mixture in process step a).

4. The process according to claim 3, wherein the metallic element M includes at least one element from the group of elements consisting of gallium, aluminum, molybdenum, niobium, tantalum, titanium and zirconium in process step a).

5. The process according to claim 3, wherein:

the powder mixture is produced in process step a) with a quantity of samarium such that a samarium content of less than 10 to 3 At-% results in the magnet body;

a grain size of less than 200 nm is generated in step b) from the powder mixture by selection of grinding intensity and grinding duration; and the grain growth is limited to a value of less than 200 nm in steps c) and d) and, in the event of a subsequent hot deformation of the magnet body, by selection of the heat treatment parameters.

6. The process according to claim 1, wherein, in order to produce the powder mixture according to process step a), a $Sm_2Fe_{17-x}M_xC_y$ alloy is produced by melt-metallurgy, where $x>0.1$ and $3\geqq y\geqq 0$, the alloy is subjected to homogenizing annealing in a temperature range of 900° C. to 1200° C. after solidification, and the alloy is then comminuted to a powder.

7. The process according to claim 1, wherein the metallic element M includes at least one element from the group of elements consisting of gallium, aluminum, molybdenum, niobium, tantalum, titanium and zirconium.

8. The process according to claim 1 wherein:

in order to produce the powder mixture according to process step a) an alloy is produced with samarium in an amount such that the samarium content in the magnet body is less than 10 to 3 At-%;

a grain size of less than 200 nm is generated in process step b) by selection of grinding intensity and grinding duration; and the grain growth is limited to a value of less than 200 nm in steps c) and d) and, in the event of a subsequent hot deformation of the magnet body, by selection of the heat treatment parameters.

9. The process according to claim 1, wherein:

in order to produce the powder mixture in accordance with process step a), a $Sm_2Fe_{17-x}Ga_xC_y$ alloy is produced by melt-metallurgical methods, where $x>0.1$ and $2\geqq y\geqq 0$;

after solidification the alloy is subjected to a homogenizing annealing in a temperature range of 900° C. to 1200° C.;

the alloy is then comminuted to a powder which is then subjected to an annealing treatment at temperatures from 600° C. to 900° C. in hydrogen gas and then under a vacuum; and the powdered alloy is then alloyed up to a $Sm_2Fe_{17-x}Ga_xC_y$ alloy, where $y\leqq 3$, by means of heat treatment in a temperature range from 400° C. to 600° C. in a carbon-containing gas.

10. The process according to claim 9, wherein $CH_4$ or $C_2H_2$ is used as carbon-containing gas to alloy the powder.

11. The process according to claim 6 wherein the metallic element M includes at least one element from the group of elements consisting of gallium, aluminum, molybdenum, niobium, tantalum, titanium and zirconium.

12. The process according to claim 6 wherein:

the alloy is produced with samarium in an amount such that the samarium content in the magnet body is less than 10 to 3 At-%;

a grain size of less than 200 mn is generated in process step b) by selection of grinding intensity and grinding duration; and the grain growth is limited to a value of less than 200 nm in steps c) and d) and, in the event of a subsequent hot deformation of the magnet body, by selection of the heat treatment parameters.

* * * * *

UNITED STATES PATENT AND TRADEMARK OFFICE

CERTIFICATE OF CORRECTION

PATENT NO. : 5,733,384
DATED : March 31, 1998
INVENTOR(S) : Lei CAO, et al

It is certified that error appears in the above-indentified patent and that said Letters Patent is hereby corrected as shown below:

On the title page, item [30] Foreign Application Priority Data

Jun. 14, 1995 [DE] Germany ..... 195 21 218.5
Jun. 14, 1995 [DE] Germany ..... 195 21 221.5

Signed and Sealed this

Eighteenth Day of August, 1998

Bruce Lehman

*Attest:*

BRUCE LEHMAN

*Attesting Officer*

*Commissioner of Patents and Trademarks*